US007256396B2

(12) United States Patent
Reilly

(10) Patent No.: US 7,256,396 B2
(45) Date of Patent: Aug. 14, 2007

(54) SENSITIVE GLOW DISCHARGE ION SOURCE FOR AEROSOL AND GAS ANALYSIS

(75) Inventor: Peter T. A. Reilly, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 247 days.

(21) Appl. No.: 11/172,330

(22) Filed: Jun. 30, 2005

(65) Prior Publication Data

US 2007/0023679 A1 Feb. 1, 2007

(51) Int. Cl.
*H01J 27/00* (2006.01)
*H01J 49/00* (2006.01)

(52) U.S. Cl. ..... 250/288; 250/281; 250/282; 250/299; 250/423 R; 250/424; 250/425

(58) Field of Classification Search ..... 250/288
See application file for complete search history.

(56) References Cited

U.S. PATENT DOCUMENTS 4,358,302 A * 11/1982 Dahneke ..... 55/392
4,863,491 A * 9/1989 Brandt et al. ..... 95/29
4,968,885 A * 11/1990 Willoughby ..... 250/288
5,223,131 A * 6/1993 Apffel et al. ..... 210/198.2
5,285,064 A * 2/1994 Willoughby ..... 250/288
5,447,553 A * 9/1995 Apffel et al. ..... 95/32
6,727,497 B2 * 4/2004 Scalf et al. ..... 250/288
6,924,004 B2 * 8/2005 Rao et al. ..... 427/421.1
6,943,346 B2 * 9/2005 Tan et al. ..... 250/288
6,972,408 B1 * 12/2005 Reilly ..... 250/292
7,078,679 B2 * 7/2006 Westphall et al. ..... 250/287
2005/0073683 A1 * 4/2005 Gard et al. ..... 356/337
2006/0102837 A1 * 5/2006 Wang et al. ..... 250/288
2007/0023644 A1 * 2/2007 Gard et al. ..... 250/288
2007/0023679 A1 * 2/2007 Reilly ..... 250/426

OTHER PUBLICATIONS

Scott A. McLuckey, Douglas E. Goeringer, Keiji G. Asano, Gopalakrishnan Vaidyanathan and James L. Stephenson, Jr., High Explosives Vapor Detection by Glow Discharge-Ion Trap, Mass Spectrometry.
M. Rami Alfarra, Thesis—Ch. III—The Aerodyne Aerosol Mass Spectrometer (AMS) , pp. 51-78.

* cited by examiner

*Primary Examiner*—Robert Kim
*Assistant Examiner*—Bernard Souw
(74) *Attorney, Agent, or Firm*—Akerman Senterfitt; Gregory A. Nelson; Eduardo Quinones

(57) ABSTRACT

A high sensitivity glow discharge ion source system for analyzing particles includes an aerodynamic lens having a plurality of constrictions for receiving an aerosol including at least one analyte particle in a carrier gas and focusing the analyte particles into a collimated particle beam. A separator separates the carrier gas from the analyte particle beam, wherein the analyte particle beam or vapors derived from the analyte particle beam are selectively transmitted out of from the separator. A glow discharge ionization source includes a discharge chamber having an entrance orifice for receiving the analyte particle beam or analyte vapors, and a target electrode and discharge electrode therein. An electric field applied between the target electrode and discharge electrode generates an analyte ion stream from the analyte vapors, which is directed out of the discharge chamber through an exit orifice, such as to a mass spectrometer. High analyte sensitivity is obtained by pumping the discharge chamber exclusively through the exit orifice and the entrance orifice.

23 Claims, 11 Drawing Sheets

SENSITIVE GLOW DISCHARGE ION SOURCE FOR AEROSOL AND GAS ANALYSIS

STATEMENT REGARDING FEDERALLY SPONSORED RESEARCH OR DEVELOPMENT

The United States Government has rights in this invention pursuant to Contract No. DE-AC05-000R22725 between the United States Department of Energy and UT-Battelle, LLC.

FIELD OF THE INVENTION

The invention relates glow discharge ion sources, more particularly high sensitivity glow discharge ion sources and related spectrometer-based analytical systems for the analysis of particles, and related methods.

BACKGROUND OF THE INVENTION

A variety of ion sources are available for generating an ion beam. Types of ion sources include electron impact ionization (EI), chemical ionization (CI), glow discharge ionization (GDI), fast atom bombardment, matrix-assisted laser desorption ionization (MALDI), Thermal ionization (TIMS), Secondary ionization (SIMS), Selected Ion Flow Tube and Plasma source. EI and CI are commonly used for gas phase analysis by most commercially available instruments. GDI as disclosed by McLuckey et al. is exclusively for gas phase analysis. The arrangement disclosed by McLuckey et al. provides better sensitivity as compared to the sensitivity typically achieved by commercial instruments (1 pg) using standard electron impact (EI) and chemical ionization (CI) ion sources [See McLuckey, S. A., Goeringer, D. E., Asano, K. G., Vaidyanathan, G. and Stephenson, J. L. (1996). "High explosives vapor detection by glow discharge ion trap mass spectrometry." Rapid Communications in Mass Spectrometry 10:287-298].

The schematic of a conventional atmospheric sampling glow discharge ion source system 100 according to McLuckey et al. is shown in FIG. 1(*a*). System 100 includes a discharge chamber 101 which comprises a set of parallel plate electrodes A1 and A2. Vapor phase molecules are introduced into the discharge chamber 101 using a carrier gas. A sufficient voltage difference is applied across the electrodes A1 and A2 to induce a glow discharge between the electrodes, so that vapor phase molecules entering the discharge chamber 101 through entrance orifice 105 are ionized by the glow discharge. The typical pressure in the discharge chamber 101 of about 800 mTorr is maintained by roughing pumps which typically pump through four (4) one half inch diameter pumping ports 151-154 as seen in the top cross section view of the pumping port configuration shown in FIG. 1(*b*). Ions generated in discharge chamber 101 are directed out of discharge chamber 101 through exit orifice 110, such as to an ion trap mass spectrometer. Reference 115 is an Einsel lens system use to focus the ions into the ion trap mass spectrometer 120. Although 120 is shown as an ion trap mass spectrometer, it can be any type of mass spectrometer.

The ion trap portion of ion trap mass spectrometer 120 shown in FIG. 1(*a*) comprises a ring electrode 121, an entrance end cap electrode 122 and an exit end cap electrode 123 placed opposite each other with the ring electrode 121 between them forming an ion trap space surrounded by the ring electrode 121, the entrance end cap electrode 122 and the exit end cap electrode 123. The electronics associated with ion trap 120 include a primary RF voltage generator for applying an RF voltage to the ring electrode 121 to trap object ions of a predetermined mass-to-charge ratio, and auxiliary voltage generator for applying an auxiliary AC voltage to the end cap electrodes 122 are not shown for simplicity.

FIG. 2 shows the tandem mass spectrum ($MS^2$) obtained from the injection of 500 fg of RDX explosive into an oven (not shown) located directly in front of the entrance orifice 105 on electrode A1 in FIG. 1(*a*). The inset of FIG. 2 shows the total ion chromatogram signature as the RDX vapor diffuses into the discharge chamber 101. It is noted that the GDI process is gentle enough to limit dissociation to yield parent ions, even for explosives.

Each point in the chromatogram shown represents a mass spectrum. Consequently, the entire 500 fg sample is spread out over approximately 20 mass spectra. The signal to noise ratio in the MS/MS spectrum is approximately 30. Therefore, the estimated analyte sensitivity is approximately 10 fg provided the entire sample is injected into the discharge all at once as would be the case for particle injection into the discharge chamber 101.

The sensitivity of conventional atmospheric glow discharge ion sources, such as the ion source shown in FIG. 1(*a*), is limited by pumping away of analyte via the four (4) half inch diameter roughing ports 151-154 used to maintain the discharge chamber pressure between about 0.1 to 1.0 Torr. The vast majority of the gaseous analyte admitted through the entrance orifice 105 in electrode A1 into discharge chamber 101 is removed and thus cannot be analyzed when it is pumped out through the roughing ports, as opposed to the desired path where it passes through the typically 200-μm diameter exit orifice 110 in electrode A2 into the ion trap mass spectrometer 120 for detection. A rough estimate of the ratio of analyte exiting through the pumping ports to the analyte sampled into the main chamber can be obtained from the ratio of the total cross sectional area of the pumping ports to the area of the exit orifice 110 at electrode A2, which is approximately 16,000.

SUMMARY OF THE INVENTION

A high sensitivity glow discharge ion source system includes an aerodynamic lens having a plurality of constrictions for receiving an aerosol including at least one analyte particle in a carrier gas and focusing the analyte particles into a collimated particle beam. A separator, such as a skimmer, separates the carrier gas from the analyte particle beam, wherein the analyte particle beam or vapors derived from the analyte particle beam are selectively transmitted out of from the separator. A glow discharge ionization source includes a discharge chamber having an entrance orifice for receiving the analyte particle beam or analyte vapors, and a target electrode and discharge electrode therein. An electric field applied between the target electrode and discharge electrode generates an analyte ion stream from the analyte vapor, which is directed out of the discharge chamber through an exit orifice, such as to a mass spectrometer. High analyte sensitivity is obtained by pumping the discharge chamber exclusively through the exit orifice and the entrance orifice.

In a preferred embodiment, the discharge chamber includes a gas inlet, wherein the pressure in the discharge chamber is controlled by leaking a gas into the discharge chamber through the gas inlet. The system can include a differential mobility analyzer coupled to an inlet of the aerodynamic lens. In this embodiment particles entering the inlet of the aerodynamic lens system are substantially monodisperse after size selection by the differential mobility analyzer. The system can also include an electrostatic Einsel lens system interposed between the separator and the entrance orifice of the discharge chamber. In another embodiment of the invention, the system further comprises a charged needle for generating a corona discharge disposed proximate to an inlet of the aerodynamic lens for charging the particles before entering an inlet of the aerodynamic lens.

A variety of vaporization sources can be used with the invention. At least one heater can be provided for heating the discharge chamber or target electrode to provide analyte vapors from the analyte particle beam. In one embodiment of the invention, the system includes a source of radiation and the aerodynamic lens includes an optically transparent window for transmitting the radiation into the aerodynamic lens. The particle beam is thus subjected to an atmospheric discharge to provide analyte vapor before reaching the entrance orifice of the discharge chamber. The source of radiation can be a pulsed laser. The system can also include a separate vaporization chamber coupled to the discharge chamber for vaporizing particles in the analyte particle beam to provide analyte vapors.

In another inventive embodiment, a gas sampling system is provided. The gas sampling system includes a shutter which prevents particles from the aerodynamic lens from reaching the discharge chamber, and a flow conduit connecting a distal end of the aerodynamic lens to the discharge chamber. Such a system provides exclusively analyte vapors to the discharge chamber. A mass spectrometer or ion mobility spectrometer (IMS) can be coupled to the ion source system.

A method of generating an ion beam from analyte particles comprises the steps of providing an aerosol comprising at least one analyte particle in a carrier gas, focusing the analyte particles into a collimated analyte particle beam, and separating the carrier gas from the analyte particle beam, wherein the analyte particle beam or carrier gas are selectively transmitted out of the separator. Carrier gas or vapors derived from the particles comprising the analyte particle beam are ionized to form an analyte ion stream using glow discharge ion ionization. The glow discharge ionization preferably takes place in a glow discharge ion source having a discharge chamber, the discharge chamber having an entrance orifice for receiving analyte particles or analyte vapors and an exit orifice for transmitting out the ion stream, wherein the discharge chamber is pumped exclusively through the exit orifice and the entrance orifice. An aerodynamic lens comprising a plurality of constrictions is preferably used for the focusing step. Pressure in the discharge chamber can be controlled by leaking a gas into the discharge chamber. The method can further comprise the step of analyzing the analyte ion stream using mass spectrometry or ion mobility spectrometry.

The method can further comprise the step of heating at least one of the discharge chamber and a target electrode in the discharge chamber to generate analyte vapors from the analyte particle beam. The method can also include the step of irradiating the particles after impact deposition onto an electrode, such as with a laser.

In another embodiment, the method further comprises the step of shuttering particles from the aerodynamic lens from reaching the discharge chamber, and pulling carrier gas from a distal end of the aerodynamic lens to the discharge chamber. In this embodiment, exclusively carrier gas reaches the discharge chamber for ionization.

BRIEF DESCRIPTION OF THE DRAWINGS

A fuller understanding of the present invention and the features and benefits thereof will be accomplished upon review of the following detailed description together with the accompanying drawings, in which:

FIG. 1(*b*) is a top cross section view of the pumping port configuration shown in FIG. 1(*a*).

FIG. 3(*b*) shows an alternate embodiment of an ion source comprising system which directly samples gas from the aerolens system.

FIG. 3(*c*) shows another alternate embodiment of an ion source comprising system according to the invention which includes to a separate vaporization chamber which can be rapidly heated for temperature programmed desorption. Aerodynamic lens system and skimmer are not shown.

DETAILED DESCRIPTION OF THE PREFERRED EMBODIMENTS

A high sensitivity glow discharge ion (GDI) source system comprises an aerodynamic lens comprising a plurality of constrictions for receiving an aerosol comprising at least one analyte particle in a carrier gas and focusing the analyte particle into a collimated particle beam. A separator, such as a skimmer, separates the carrier gas from the analyte particle beam, wherein the analyte particle beam or carrier gas are selectively transmitted out of the separator. A glow discharge ionization (GDI) ion source includes a discharge chamber which comprises an entrance orifice for receiving the analyte particle beam or analyte vapors, and a target electrode and discharge electrode therein. An electric field applied between the target electrode and discharge electrode generates an analyte ion stream from the analyte vapors. An exit orifice is provide for transmitting the analyte ion stream out from the discharge chamber, such as to a mass spectrometer or ion mobility spectrometer for detection and identification.

Vaporization of analyte particles is an important aspect of the invention and can be provided using a variety of methods described herein. The method of vaporization selected controls the range of analytes from the particles analyzed. Semivolatiles, such as explosive and a variety of other analytes of interest, are found primarily in the condensed state. The ability to analyze particles makes the invention effective for detecting these analytes. The steps in the inventive method generally include sampling the analyte containing particle, vaporizing the analyte, and ionizing the analyte vapors using GDI.

The invention can also be configured to receive gas to be analyzed, with no particles from the aerosol being provide to the discharge chamber. For example, an inventive embodiment is provided which pulls gas from the aerodynamic lens system after the particle beam has been collimated but before the final expansion.

Figure 1A:
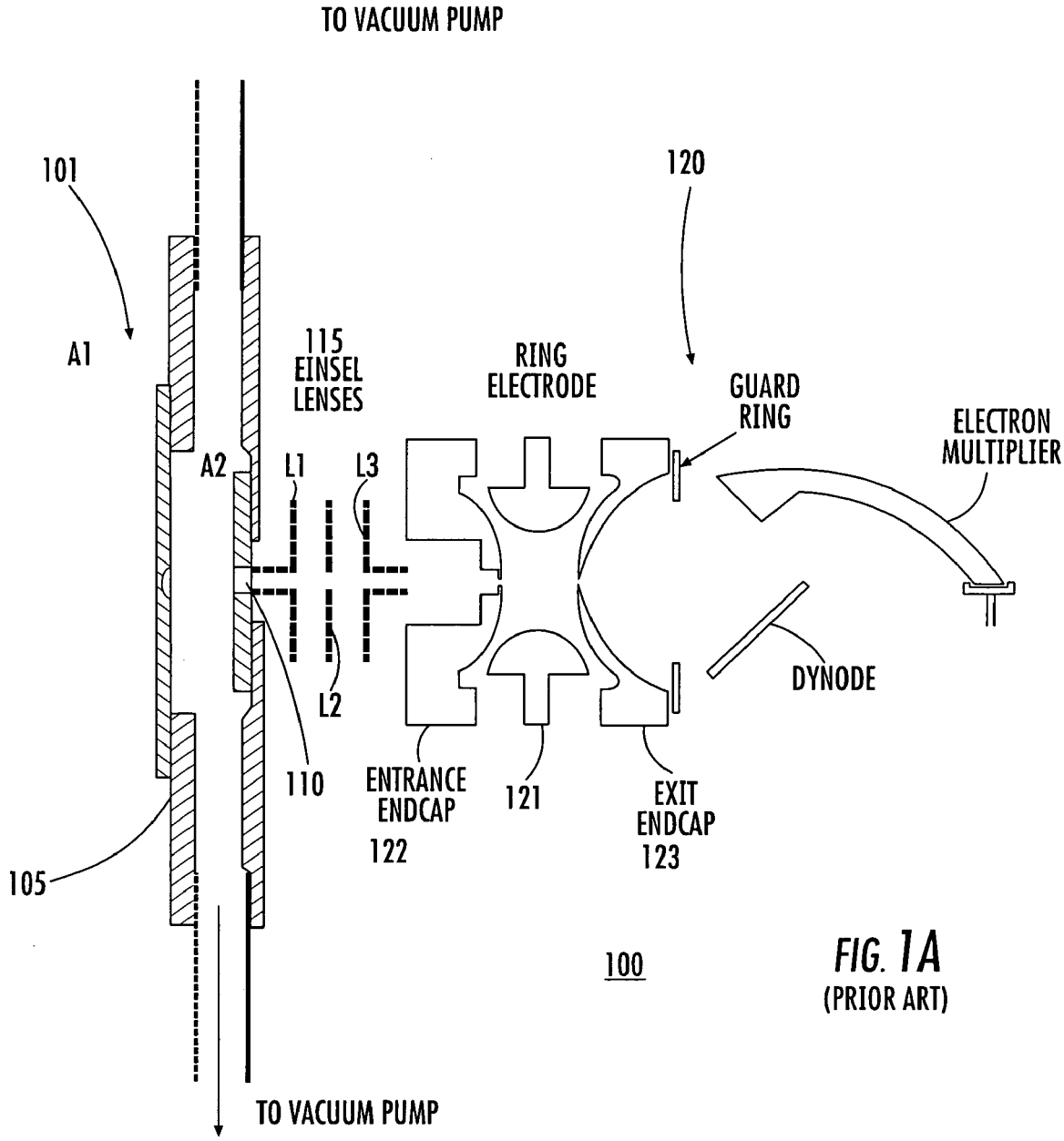
FIG. 1A (PRIOR ART)
FIG. 1(*a*) shows the schematic of a conventional prior art ion trap mass spectrometer system including an atmospheric sampling glow discharge ion (GDI) source.
Figure 1B:
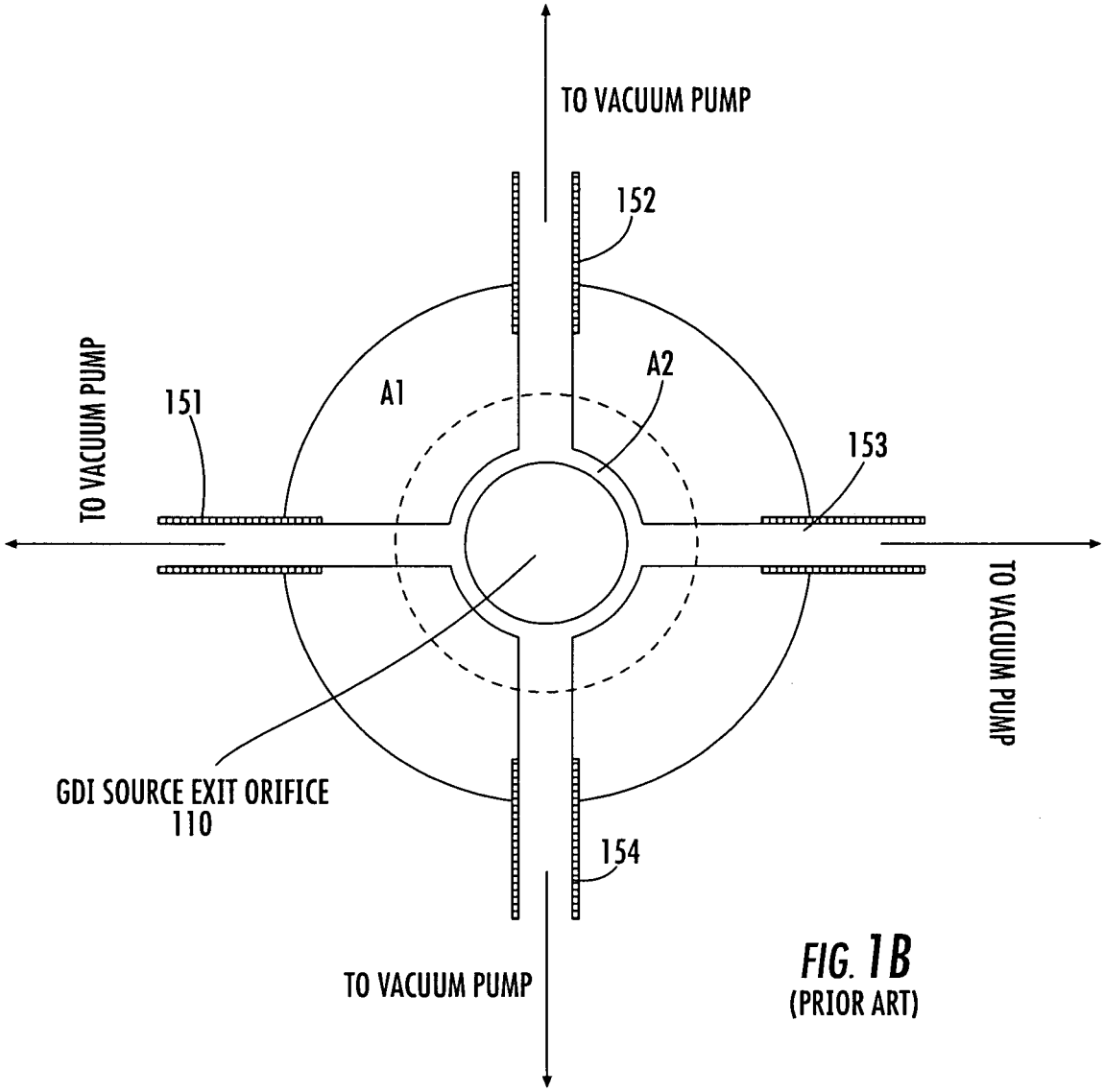
FIG. 1B (PRIOR ART)
Figure 2:
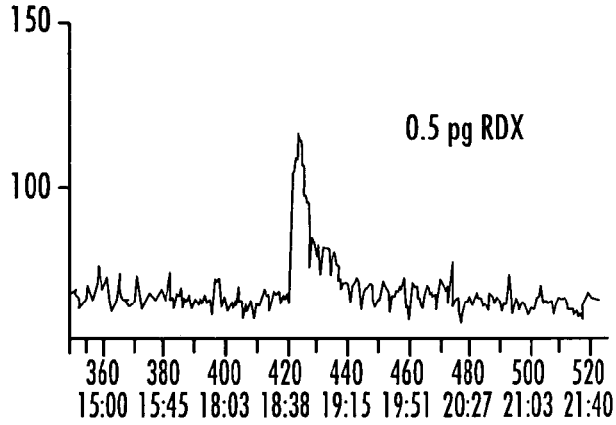
FIG. 2 (PRIOR ART)
FIG. 2 shows the tandem mass spectrum ($MS^2$) obtained from the injection of 500 fg of RDX explosive into an oven (not shown) located directly in front of the entrance orifice on electrode A1 for the conventional ion trap mass spectrometer system including an atmospheric glow discharge ion source shown in FIG. 1(*a*). The inset of FIG. 2 shows the total ion chromatogram signature as the RDX vapor diffuses into the discharge chamber.
Figure 2:
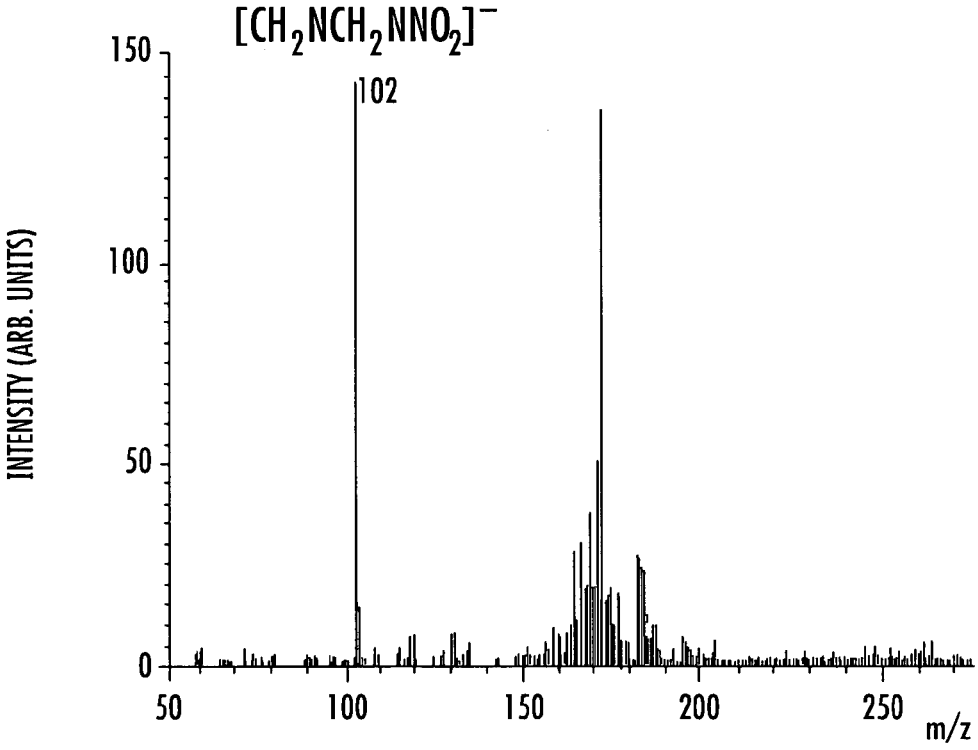
FIG. 2 (PRIOR ART)

The inventive ion source is a versatile source that can be used for a variety of spectrometers to permit the real-time analysis of atmospheric aerosols and gases. Significantly, ion sources according to the invention reduce analyte losses by eliminating the need for rough pumping ports previously used to maintain the necessary operating pressure of the atmospheric sampling glow discharge source, such as shown in FIGS. 1(*a*) and (*b*) and described in the background above. By eliminating direct pumping in the ion source, the invention can increase the sensitivity of the mass spectrometer by approximately three orders of magnitude (1000×) into the attogram range, such as 1 to 10 attograms. An attogram is one-thousandth of a femtogram, or $1\times10^{-18}$ grams.

Figure 3A:
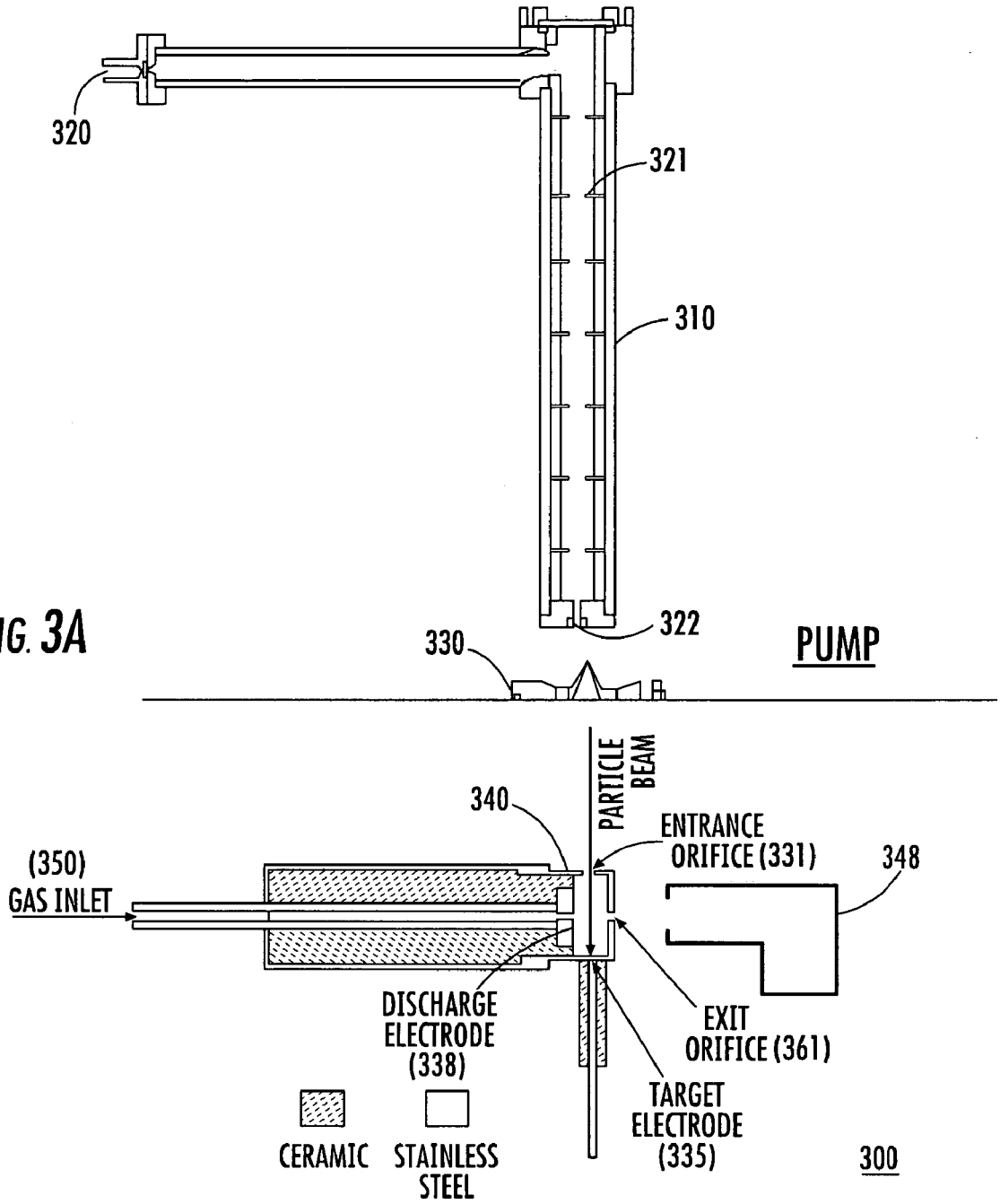
FIG. 3(*a*) shows a generalized schematic of an ion source comprising system according to an embodiment of the invention.
Figure 3B:
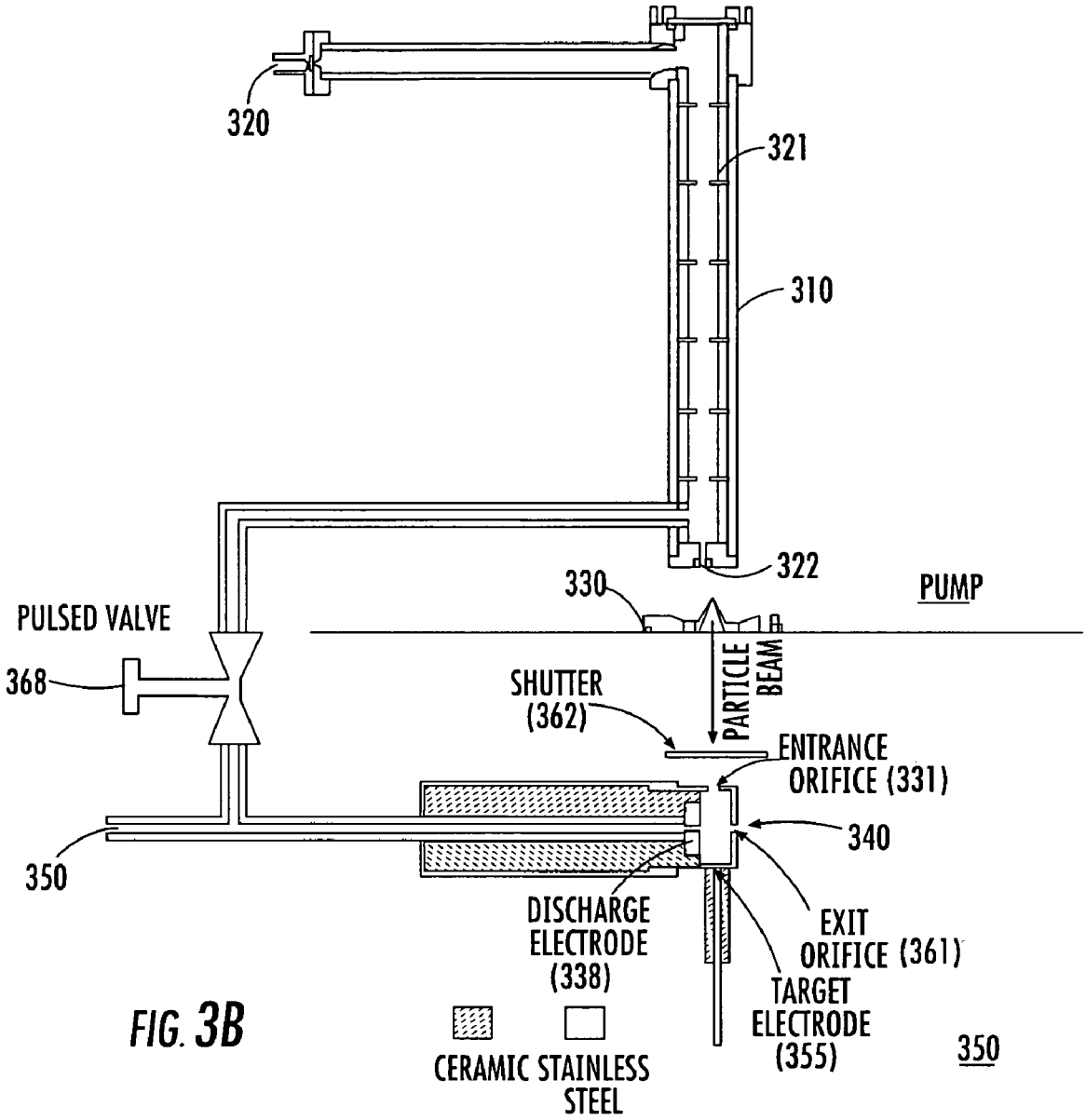
Figure 3C:
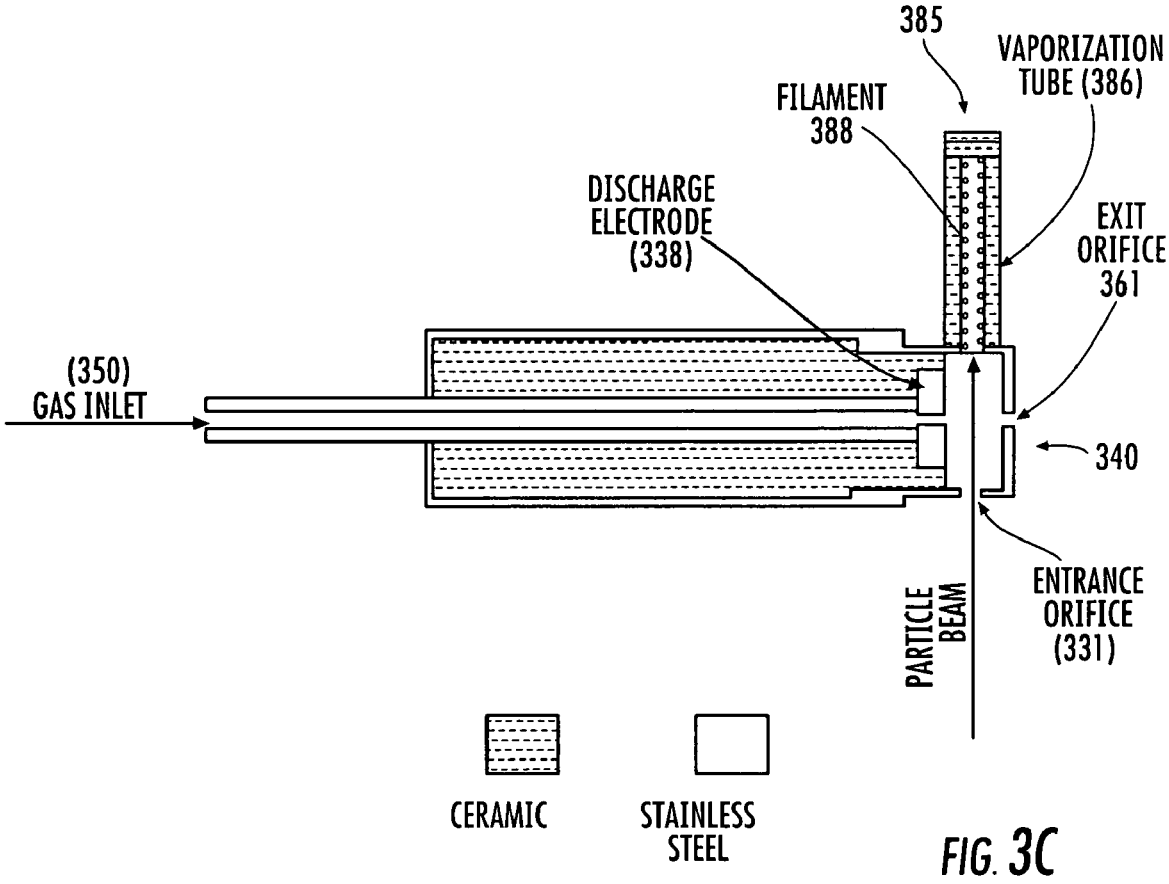

A generalized schematic of a ion source comprising system 300 according to an embodiment of the invention is shown in FIG. 3(*a*). Aerosol particles together with the carrier gas enter the inlet of an aerodynamic lens system 310 through a small inlet orifice 320. In the case of conventional atmospheric sampling, the carrier gas is air. Details regarding a suitable aerodynamic lens system can be found, for example, in the following papers: [see Liu, P., Ziemann, P. J., Kittelson, D. B. and McMurry, P. H. (1995). "Generating Particle Beams of Controlled Dimensions and Divergence; Experimental Evaluation of Particle Motion in Aerodynamic Lenses and Nozzle Expansions."

After expansion through inlet orifice 320, the motion of the particles becomes randomized by collisions and entrained in the flow of the background gas. The particles then pass through a series of constrictions of sequentially decreasing diameter (aerodynamic lenses) 321 that push the particles toward the central axis of the lens system 310. The aerodynamic lens system 310 creates a very well collimated particle beam (typically <0.25 mm diameter) over a wide range of particle sizes. Particles whose trajectories are on the central axis at the exit of the lens system 310 remain collimated during the final expansion before skimmer cone 330 which is interposed between the outlet 322 of aerodynamic lens 310 and the entrance orifice 331 of discharge chamber 340. As known in the art, skimmers are generic and generally comprise a cone with a hole in the center. A variety of skimmer designs can be used. When a turbo pump (not shown) is used to pump the lens system 310, the hole in the skimmer 330 can be on the order of a millimeter in diameter and maintain the pressure in the main chamber. Thus, creation of the particle beam with the aerodynamic lens starts the separation process. Passing the particle beam through differentially pumped chambers, having skimmer 330 therebetween, completes the separation process.

The particle beam, stripped of its carrier gas, then enters the discharge chamber 340 and deposits on the target electrode, wall or separate heated chamber to vaporize. Carrier gas as described below may also be separately into the discharge chamber 340 for analysis. The target electrode 335 preferably provides a small collection surface from which the analyte particles are vaporized, such as with a laser. Discharge electrode 338 is also provided in discharge chamber 340.

Figure 4:
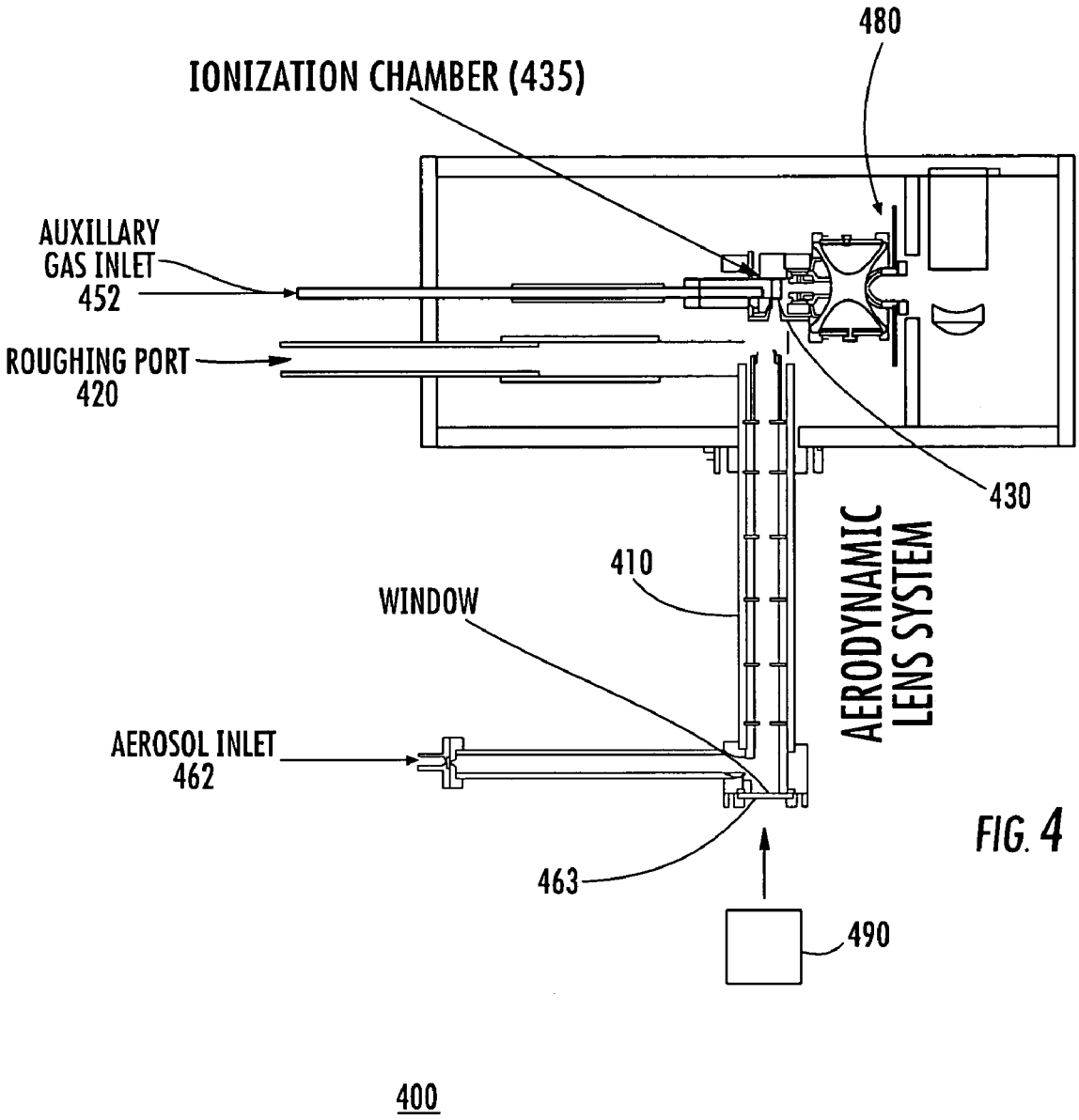
FIG. 4 shows the schematic for a glow discharge ion source comprising detection system according to an embodiment of the invention useful for detecting specific analytes in aerosols, such as explosives or other illicit substances, when particle-size discrimination is not an important selection factor.

The invention is not limited to conventional atmospheric sampling GDI sources. Vaporization can be accomplished using a variety of methods, including heating the discharge chamber, utilizing laser desorption into the discharge chamber (see FIG. 4 described below), as vaporizing analyte particles in a separate rapidly heated vaporization chamber (See FIG. 3(*c*) described below).

The discharge chamber 340 can be heated for flash thermal vaporization of the more volatile species. The target electrode 335 can be separately heated and of various shapes for catching the incoming particles, such as a cup shape. The semivolatile material of the collected particles can be continuously vaporized by keeping the target electrode 335 at a specific temperature, or the temperature of the target electrode 335 can be ramped for programmed desorption into the ionization region. The discharge in the ionization region of discharge chamber 340 can also be pulsed to produce ions as needed.

If the particles in the particle beam are charged before they enter the aerosol inlet 320 of the aerodynamic lens system 310, such as using an atmospheric corona discharge or some other charging method, the analyte ions can be collected on an oppositely charged target electrode 335 disposed on the far side of the discharge chamber 340. Such pre-charging is generally needed to permit sensitive operation for smaller particles that may not efficiently make it to the target electrode 335 disposed on the far side of the discharge chamber 340 without their motion being randomized by collisions with the gas in the discharge chamber 340.

The bias on electrode 335 can be switched off after a period of particle collection to keep it from affecting the discharge. The collected particles can also be vaporized thermally by heating the discharge chamber or by laser desorption from the target electrode 335. Heating the entire discharge chamber volume to some reasonably high constant temperature, such as 300° C. permits analysis of species that are easily vaporized and can be useful provided there are not too many background ions created.

After the bias on the collection electrode is switched off, a potential can be applied to the discharge electrode 338 to initiate the discharge and commence ionization of the evolving gases for the particles. With negative ion glow discharge, background ions are almost nonexistent because normal background gases such as $O_2$, $N_2$, $H_2O$ and hydrocarbons that exist in relatively high concentrations in the atmosphere do not readily undergo electron attachment to create negative ions. In comparison, background ions can be a problem for electron impact (EI) sources because almost all species form positive ions by electron impact. EI sources also cause significantly more fragmentation of analyte as compared to the glow discharge ion source according to the invention.

Moreover, the discharge current generally provided using glow discharge sources is typically thousands of times greater electron beam current provided by EI sources. As a result, the sensitivity of ion sources according to the invention is much higher than EI sources, generally permitting single particle detection, such as for detection of explosive particles. Because of the increased sensitivity of the glow discharge source, the gas input to the discharge should be very clean. A suitable filtering system can be used to scrub the discharge gas of particles and gaseous impurities that create background ions.

The discharge chamber 340 preferably further comprises a gas inlet 350. In this arrangement, the pressure in the discharge chamber 340 is controlled by leaking a filtered gas into the discharge chamber 340 through gas inlet 350. The pressure in the discharge chamber 340 is preferably maintained with filtered air through a leak valve (not shown in FIG. 3; instead, see FIG. 5). Significantly, in this arrangement, the discharge chamber 340,is pumped exclusively via the exit orifice 361 of discharge chamber 340 and the entrance orifice 331 of discharge chamber thus eliminating the need for roughing pumps to maintain the pressure in the discharge chamber 340. Analyte ions pass through the exit orifice 361 and are forwarded to the mass spectrometer 348 while analyte pumped into entrance orifice 331 continues to be available for detection. The inventive pumping arrangement thus can enhance the sensitivity of the ion source system 300 into the attogram range.

In an alternate embodiment of the invention shown in FIG. 3(*b*), system 350 analyzes atmospheric gases directly with the ability to provide parts per billion sensitivity. Particles from the aerodynamic lens inlet system 310 are shuttered by shutter 362 to keep particles from entering the discharge chamber 340. The shutter is closed when analyzing the carrier gas. In a preferred embodiment, gas from lens system 310 is directed to valve 368 to control the flow of carrier gas to gas inlet 350 to permit entry into discharge chamber 340. Thus, particle free gases collected from a distal end (e.g. the last stage(of the aerodynamic lens system 310 can be injected directly into the discharge chamber thus bypassing skimmer 330 to provide particle free gas to the discharge chamber 340.

Vaporization can also be provided in a separate vaporization chamber described below relative to FIG. 3(*c*). Having a separate rapidly heated chamber permits particle collection and temperature programmed desorption permitting better separation of analyte and background. FIG. 3(*c*) shows another alternate embodiment of an ion source comprising system 380 according to the invention which includes to a separate vaporization chamber 385 which can be rapidly heated for temperature programmed desorption. Aerodynamic lens system 310 and skimmer 330 are not shown. Vaporization chamber 385 includes vaporization tube 386 and filament 388. Particles from the particle beam enter vaporization tube 386 where they are vaporized from heat generated by filament 388. Vapors then enter discharge chamber 340 where ionization takes place. Although not shown, vaporization chamber 385 preferably includes electronics for temperature programmed desorption.

Several exemplary glow discharge ion source comprising detection system embodiments according to the invention are described below. System 400 shown in FIG. 4 was designed primarily as a proof of principle system. However, system 400 is applicable when looking for specific analytes in aerosols, such as explosives or other illicit substances, when the application is not particularly interested in particle-size discrimination. System 400 includes radiation source 490 which provides a focused laser pulse or other high energy beam focused along the axis of the aerodynamic lens system 310 for ablating analyte particles into vapor. Laser or other high energy beam vaporization permits analysis of analytes including salts and other species that are generally difficult to vaporize.

System 400 uses a roughing pump (not shown) acting though roughing port 420 to create the desired pressure drop through the aerodynamic lens system 410. A well-collimated particle beam exits the aerodynamic lens system 410, passes through skimmer 430, then into vaporization/discharge chamber 435. The pressure at the exit of the lens system 410 (before the discharge chamber 435) is approximately 350 mTorr with a 100-μm diameter aerosol inlet orifice 462 and a 450 L/min roughing pump. The pressure in the discharge chamber 435 ranges from 100 to 1000 mTorr to support the glow discharge. An auxiliary gas inlet 452 provides extra gas flow (if needed) to adjust the pressure in the discharge chamber 435 to optimize the discharge. The exit orifice of discharge chamber 435 is coupled to an ion trap mass spectrometer 480. System 400 does not provide size discrimination and does not analyze particles below about 50-nm well because their trajectories out of the aerodynamic lens system 410 are quickly arrested by collisions with the background gas before they make it into the discharge chamber 435.

An optically transparent window 463 located at the top of the aerodynamic lens system 410 permits the collected aerosol to be vaporized with a focused laser pulse or other high energy beam from radiation source 490 before entering the discharge chamber 435. The source of radiation can be a pulsed laser or other suitable source capable of vaporizing particles of interest. Using such an arrangement, the aerosol particles are subjected to an atmospheric discharge before reaching the inlet of discharge chamber 435 to facilitate collection of the particles at the target electrode inside the discharge chamber 435. As noted above, alternatively, or additionally, the discharge chamber 435 can be heated to provide thermal desorption of the aerosol components into the discharge.

Figure 5:
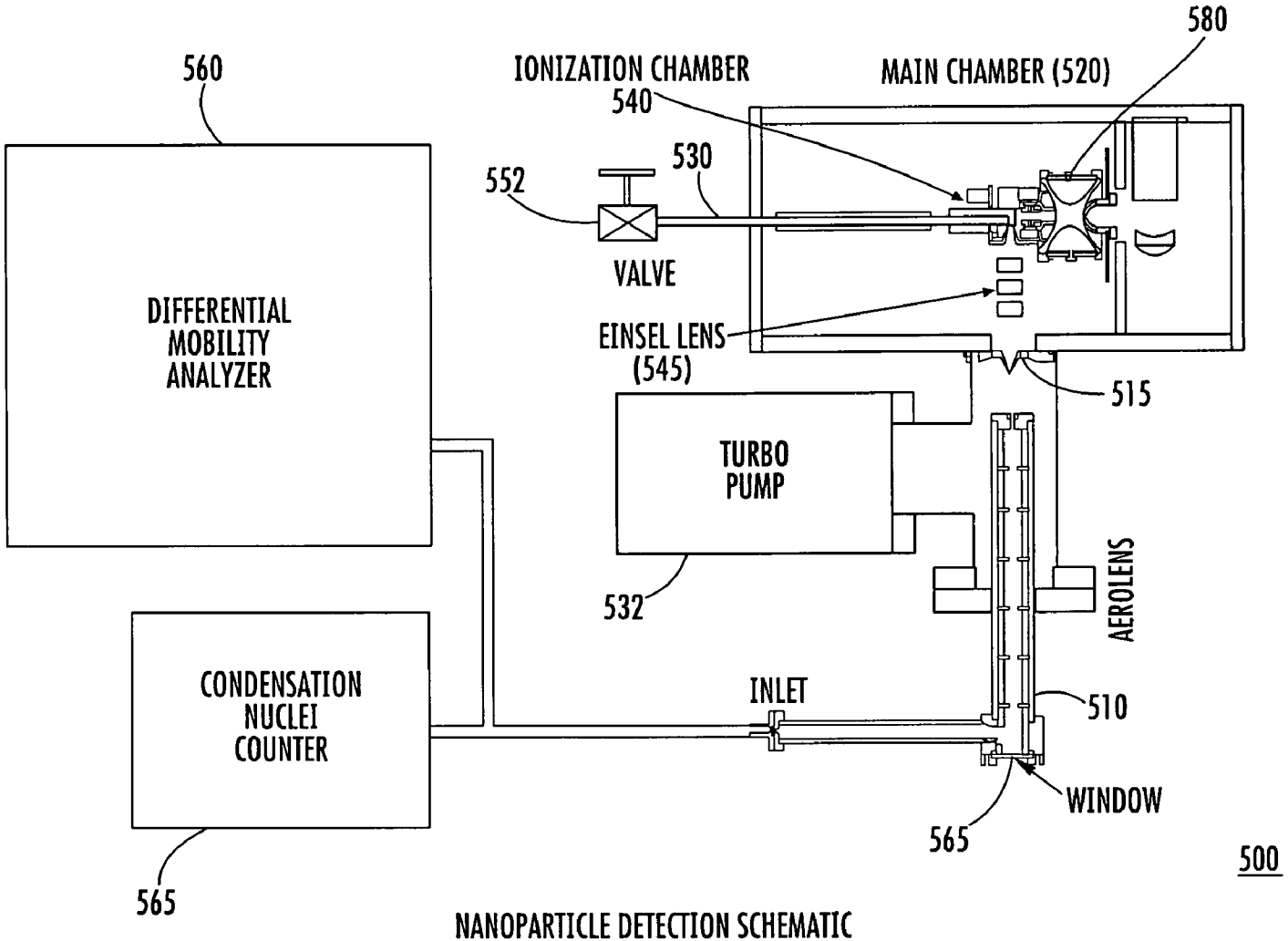
FIG. 5 provides a schematic of a glow discharge ion source comprising detection system according to an embodiment of the invention which permits size discriminated analysis from 10-nm to approximately 2-μm.
Figure 7:
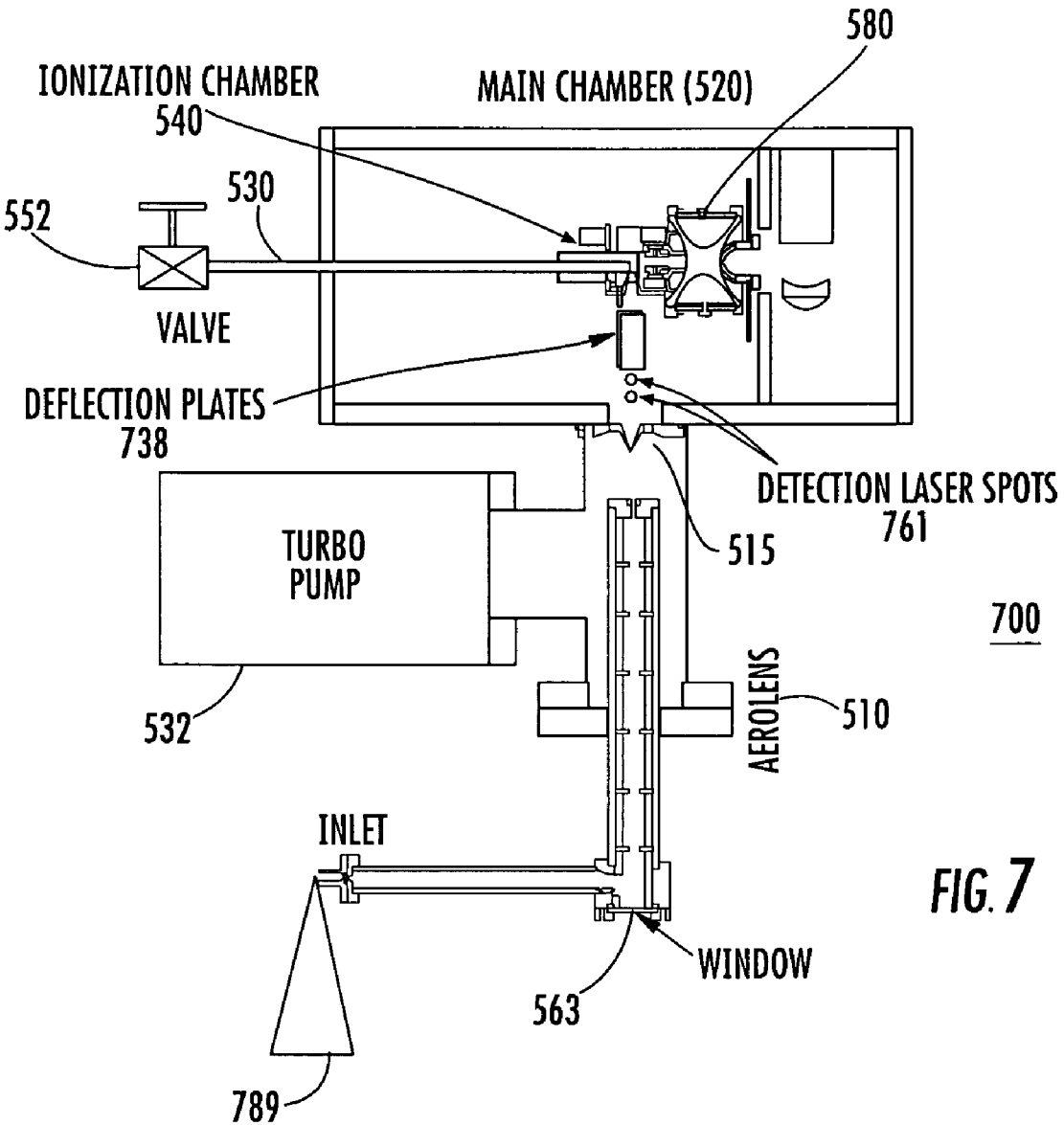
FIG. 7 shows a schematic of a glow discharge ion source comprising detection system according to an embodiment of the invention which permits the measurement of particles above 1-μm in diameter, thus providing measurements in the coarse particle range.

FIGS. 5 and 7 show exemplary glow discharge ion source comprising detection systems according to the invention which besides compositional analysis also provide size discrimination. FIG. 5 provides a schematic of a glow discharge ion source comprising detection system 500 which permits size discriminated analysis for particles having sizes from 10 nm to approximately 2 μm. System 500 includes an aerodynamic lens system 510 having an inlet chamber pumped by a turbo pump 532, such as a 70 l/s turbo drag pump. A similar inlet tested operated at a 20-mTorr base pressure with a 100-μm inlet orifice. This low base pressure allows 10-nm particles and greater to easily reach the discharge chamber 540 without being stopped by collisions with background gas.

The aerolens system 510 creates a 250-μm diameter particle beam range of particle sizes. The particle beam begins to diverge as the particle size drops below approximately 40 nm. However, the approximately 20 mTorr pressure in the inlet chamber of aerodynamic lens system 510 permits the use of a 1-mm diameter skimmer 515 at the entrance to the main chamber 520 so that a large portion of the smaller particles pass into the main chamber 520. As the ability to aerodynamically collimate a beam of particles decreases with size, the ability to electrostatically focus the particles increases. For this reason, an electrostatic Einsel lens system 545 is included to increase small particle (<40 nm) throughput into the discharge chamber 540. The particles entering the inlet of aerodynamic lens system 510 are primarily monodisperse in the +1 charge after size selection in the differential mobility analyzer 560. The concentration in the diluted gas stream is monitored with the condensation nuclei counter 565 provided.

System 500 also includes optional window 563 at the top of the aerodynamic lens system 510 to permit the collected aerosol to be vaporized with a focused pulse laser or other high energy beam before entering the discharge chamber 540. Auxiliary gas inlet 550 controlled by leak valve 552 provides extra gas flow (if needed) to adjust the pressure in the discharge chamber 540 to optimize the discharge. The exit orifice of discharge chamber 540 is coupled to an ion trap mass spectrometer 580.

General details of ultrafine and fine particle collection followed by laser vaporization and subsequent laser ionization have been disclosed by a group led by Johnston [See Oktem, B., Tolocka, M. P. and Johnston, M. V. (2004). "On-line analysis of organic components in fine and ultrafine particles by photoionization aerosol mass spectrometry." Analytical Chemistry 76:253-261]. Oktem et al. collected particles on an aluminum target and ablated them into a time-of-flight mass spectrometer with a 1064-nm laser where a portion of the ablation plume was ionized with a focused 118-nm laser pulse. Target substrate ions were observed in their mass spectra yet they were readily able to achieve quantitative results. The inventive method should be much more sensitive than the method disclosed by Johnston because most of the ablation plume will be sampled into the discharge and glow discharge ionization is much more efficient than a low fluence laser pulse from the $12^{th}$ order harmonic of a YAG laser disclosed by Oktem et al.

Figure 6:
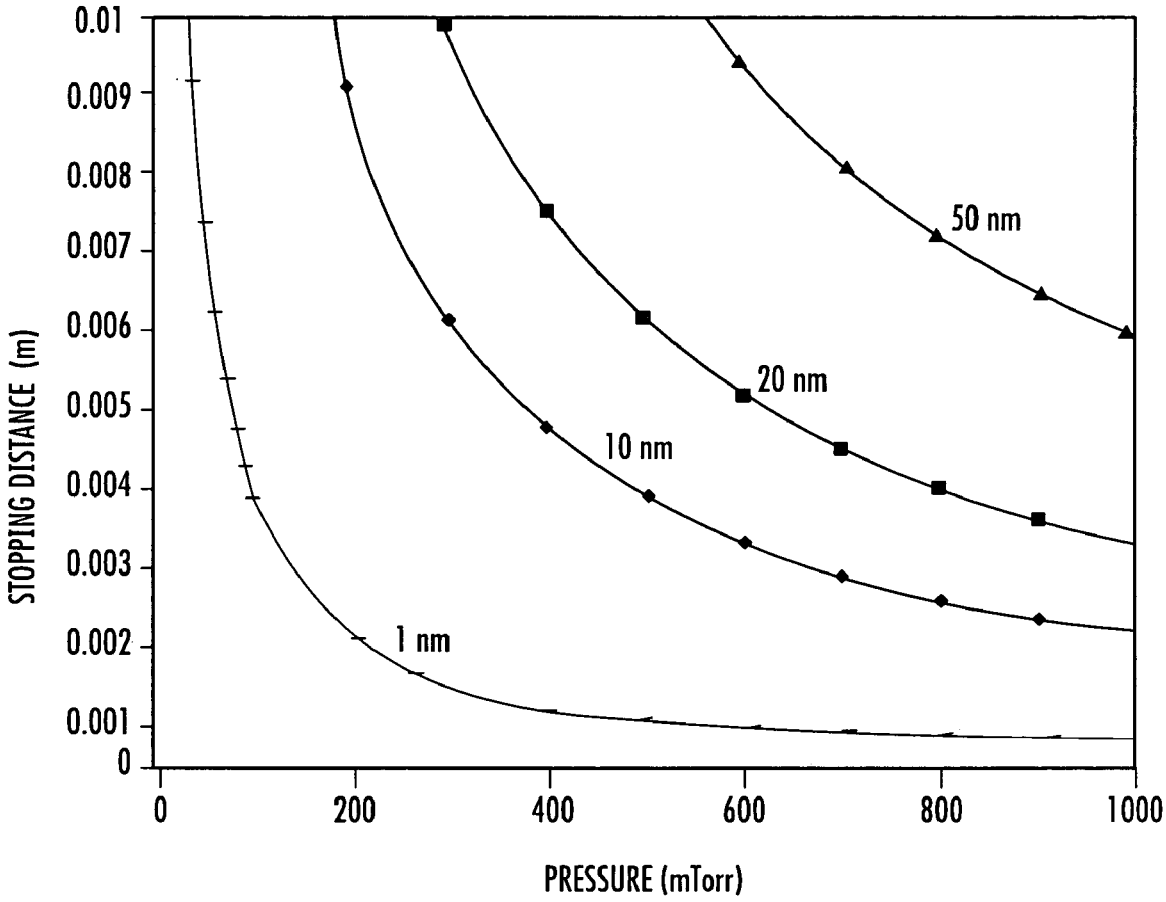
FIG. 6 provides calculated stopping distance data as a function of gas pressure over the range of conditions typically used in glow discharge ion sources.

FIG. 6 provides calculated stopping distance data as a function of gas pressure over the range of conditions typically used in glow discharge ion sources. The aerodynamic lens system preferably used with the invention is based on a design disclosed by Liu et al. [See Liu, P., Ziemann, P. J., Kittelson, D. B. and McMurry, P. H. (1995). "Generating Particle Beams of Controlled Dimensions and Divergence .1. Theory of Particle Motion in Aerodynamic Lenses and Nozzle Expansions." Aerosol Science and Technology 22:293-313; Liu, P., Ziemann, P. J., Kittelson, D. B. and McMurry, P. H. (1995). "Generating Particle Beams of Controlled Dimensions and Divergence; Experimental Evaluation of Particle Motion in Aerodynamic Lenses and Nozzle Expansions." Aerosol Science and Technology 22:314-324]. The particle velocities used in the calculations were obtained and extrapolated from the experimentally derived function given in the first experimental paper on aerodynamic lens systems. The data shown in FIG. 6 demonstrates that particles below 50 nm will not reach the opposite wall of a 1 cm diameter discharge chamber where the target electrode is disposed. Such particles will only penetrate into the discharge chamber a few millimeters before they are stopped and then randomly diffuse. For this reason, a small charged target electrode is preferably provide at the opposite wall of the discharge chamber to collect and localize the charged species so that they can be ablated into the discharge for analysis once enough sample particles have been collected.

An advantage of maintaining the discharge chamber pressure between 100 and 1000 mTorr is further separation of the atmospheric carrier gas species from the atmospheric particles. From the data shown in FIG. 6. it is clear that gaseous species 1 nm and lower (≦300 Da) will not readily penetrate the discharge chamber for ionization and sampling into the ion trap through the Einsel lens system 545. Atmospheric gases can be admitted to the discharge chamber through a pulsed leak valve when the entrance orifice to the aerodynamic lens inlet is blocked, such as valve 552 shown in FIG. 5. Valves that can admit a picoliter pulse of atmospheric gas into the discharge chamber are commercially available. This will minimize the gas load during gas phase measurements. Particulate matter will be separated from the atmospheric gas by an electrostatic precipitator (not shown) before sampling through the valve 552.

Single particle detection can be obtained using systems according to the invention by diluting the particle stream after the differential mobility analyzer 560. As noted above, the concentration in the diluted stream can be monitored with the condensation nuclei counter 565. Confirmation of the single particle status can be made by observation of the integrated total ion current (TIC) from each collected mass spectrum. Measurement of the TIC is provide by available commercial software. Particles of the same size should yield roughly the same TIC because of the nonspecific nature of the ablation and the glow discharge ionization process. Doubling of the TIC will indicate the presence of two particles while background signal levels will indicate the absence of particles. Doubles and misses can easily be sorted out of the data base to yield only single particle spectra.

The minimum particle size that will permit single particle measurement depends on the instrument sensitivity. According to calculated estimates, single particle measurements down to approximately 10 nm (~1 ag) can be made. If the glow discharge source provided the same sensitivity as the atmospheric sampling glow discharge source, then the minimum particle size for single particle measurement would be on the order of 100 nm. This is roughly the same lower size limit (50-200 nm) for the current versions of single particle mass spectrometers. Measurements on ensembles of size discriminated particles performed on particles below this limit are analytically useful and can readily be performed. The upper limit will be defined by the range of the differential mobility analyzer, approximately 2 μm.

FIG. 7 shows the schematic of a glow discharge ion source comprising detection system 700 according to the invention which permits the measurement of particles above 1-μm in diameter, thus providing measurements in the coarse particle range. Like features relative to system 500, sometimes as noted below having dimensional changes, are numbered alike. System 700 is adapted for measurements in the coarse particle range by minor changes to the front end of system 700 so that system can measure substantially the entire range of atmospheric particles sizes.

The aerodynamic lens system 510 can easily be adapted to collimate larger particle sizes by changing the diameter of the entrance orifice of discharge chamber 540, the apertures of the aerodynamic lens 510 and skimmer 515. Light scattering lasers, optics and deflection plates 738 are mounted on the top flange of the main chamber 520 and can easily replace the flange holding the Einsel lens system 545 of the main chamber in system 500 shown in FIG. 5. A charged needle 789 is preferably mounted at the entrance to the aerodynamic lens system 510 to create a corona discharge to charge the particles before they enter the inlet of aerodynamic lens system 510. Conversion from the nanoparticle system (system 500 shown in FIG. 5) to the large particle system (system 700 shown in FIG. 7) and back could be accomplished in less than an hour.

The aerodynamic lens system 510 creates a very well collimated beam of particles that passes through the skimmer 515 into the main chamber 520. In the main chamber 520, two focused diode lasers which provide detection laser spots 761 which intercept the particle beam at separate points in the path. The scattered light from the particles at each of the detection spots 761 can be collected and focused into two separate photomultiplier tubes to permit the particle's time-of-flight to be measured (See system 800 shown in FIG. 8 for added details). A potential between a pair of deflection plates 738 will divert the charged particles from the entrance orifice of discharge chamber 540 if the system 700 is not ready to receive a particle or if the particles are not the correct size as defined by their time-of-flight between the detection points. The particle size limitation of system 700 at the low end is defined by the ability to detect scattered light from single particles. This can be done without a significant drop in efficacy down to approximately 200 nm. The upper particle size limitation of system 700 is defined by the aerodynamic lens system 510 and the vacuum system. This system should easily accommodate 50-μm particles and smaller. However, this size limit could be increased with the addition of an extra stage of differential pumping.

System 700 can accommodate the same vaporization and ionization schemes as described above relative to system 500. Additionally, the particles in system 700 can be ablated in real-time as they reach the center of the discharge chamber 540 before they hit the target electrode at the back of the chamber 540 because they are being individually detected. This may avoid cross contamination, evaporation and substrate ion interference issues. This strategy will permit quantitation to be performed at the single particle level anywhere above about 200 nm.

Accordingly, by interchanging between system 500 and system 700, a single system according to the invention can produce size-resolved chemical composition measurements across the entire range of atmospheric particle sizes with minor and rapidly deployable changes to the front end of the system.

Figure 8:
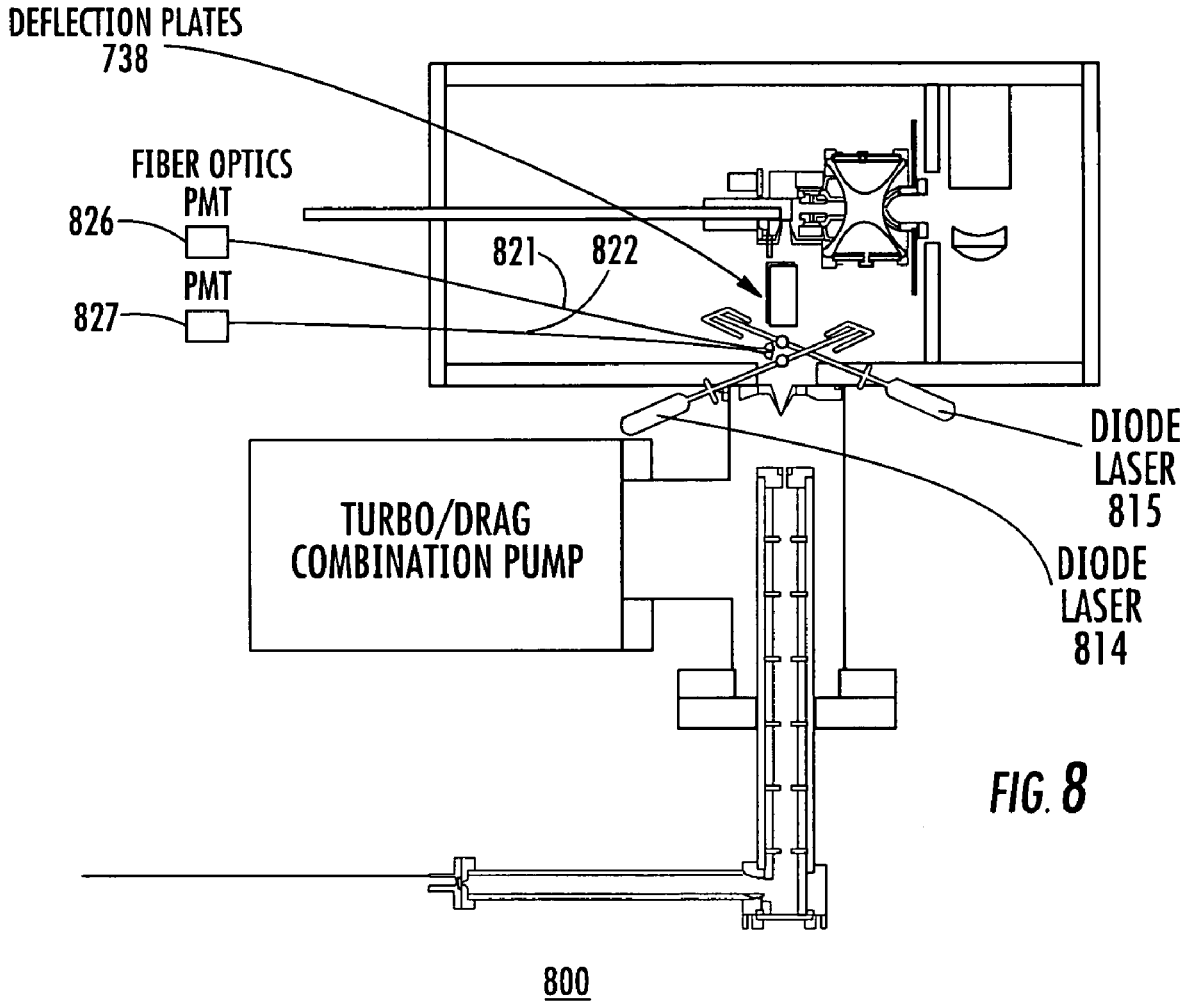
FIG. 8 shows the schematic of a glow discharge ion source comprising detection system according to the invention having a quantitative inlet with aerodynamic sizing showing details of the light detection system.

FIG. 8 shows the schematic of a glow discharge ion source comprising detection system 800 according to the invention having a quantitative inlet with aerodynamic sizing showing details of the light detection system. System 800 includes a pair of diode lasers 814 and 815. Light from lasers 814 and 815 scattered from the particles are collected and focused into fiber optic pipes 821 and 822 connected to respective photomultiplier tubes (PMTs) 826 and 827. The signal from the PMTs can be amplified and converted into TTL pulses that permits the time-of-flight of the particles, and thus their size, to be measured.

The invention can be used in a wide variety of systems for a wide variety of purposes. In one embodiment, the invention is used to enhance homeland security by detecting explosives and other illicit materials at airports, docks, etc., as well as for the detection of mines and other unexploded ordinance. As noted above, the system is capable of detecting and identifying a single explosive particle using the negative ion GDI technique and tandem mass spectrometry. The invention may also be used for bacterial detection and speciation by looking for phospholipid and fatty acid signatures in the in the mass range above about 200 Da. Aerosol induced climate change measurement systems can also utilize the invention by monitoring the composition of ambient aerosols as a function of particle size and gas phase composition. The invention may also be used for tracking systems and for aerosol source apportionment also using size based composition measurements.

It should be understood that the examples and embodiments described herein are for illustrative purposes only and that various modifications or changes in light thereof will be suggested to persons skilled in the art and are to be included within the spirit and purview of this application. The invention can take other specific forms without departing from the spirit or essential attributes thereof.

I claim:

1. A high sensitivity glow discharge ion source system, comprising:

an aerodynamic lens comprising a plurality of constrictions for receiving an aerosol comprising at least one analyte particle in a carrier gas and focusing said analyte particles into a collimated particle beam;

a separator for separating said carrier gas from said analyte particle beam, wherein said analyte particle beam or analyte vapors derived from said analyte particle beam are selectively transmitted out of from said separator, and a glow discharge ionization source comprising a discharge chamber, said discharge chamber including an entrance orifice for receiving said analyte particle beam or said analyte vapors, and a target electrode and discharge electrode therein, wherein an electric field applied between said target electrode and discharge electrode generates an ion stream from said analyte vapors, and an exit orifice for transmitting said ion stream out from said discharge chamber.

2. The source of claim 1, further comprising at least one heater for heating at least one of said discharge chamber and said target electrode to provide said analyte vapors from said analyte particle beam.

3. The source of claim 1, wherein said discharge chamber is pumped exclusively through said exit orifice and said entrance orifice.

4. The source of claim 1, wherein said discharge chamber further comprises a gas inlet, wherein a pressure in said discharge chamber is controlled by leaking a gas into said discharge chamber through said gas inlet.

5. The system of claim 1, wherein said separator comprises is a skimmer.

6. The system of claim 1, wherein said system includes a source of radiation and said aerodynamic lens includes an optically transparent window for transmitting said radiation into said aerodynamic lens, wherein said particle beam is subjected to an atmospheric discharge to provide said analyte vapor before reaching said entrance orifice of said discharge chamber.

7. The system of claim 6, wherein said source of radiation is a pulsed laser.

8. The system of claim 1, further comprising a differential mobility analyzer coupled to an inlet of said aerodynamic lens, wherein said particles entering said inlet of said aerodynamic lens system are substantially monodisperse after size selection by said differential mobility analyzer.

9. The system of claim 1, further comprising an electrostatic Einsel lens system interposed between said separator and said entrance orifice of said discharge chamber.

10. The system of claim 1, further comprising a charged needle for generating a corona discharge disposed proximate to an inlet of said areodynamic lens for charging said particles before entering an inlet of said aerodynamic lens.

11. The system of claim 1, further comprising a separate vaporization chamber coupled to said discharge chamber, said vaporization chamber vaporizing particles in said analyte particle beam to provide said analyte vapors.

12. The system of claim 1, further comprising a shutter which prevents particles from said aerodynamic lens from reaching said discharge chamber, and a flow conduit connecting a distal end of said aerodynamic lens to said discharge chamber, wherein exclusively said analyte vapors reach said discharge chamber.

13. A mass spectrometer or ion mobility spectrometer system comprising said ion source system of claim 1.

14. A method of generating an ion beam from analyte particles, comprising the steps of:

providing an aerosol comprising at least one analyte particle in a carrier gas;

focusing said analyte particles into a collimated analyte particle beam;

separating said carrier gas from said analyte particle beam, wherein said analyte particle beam or carrier gas are selectively transmitted out of from said separator, and ionizing said carrier gas or vapors derived from said analyte particle beam to form an analyte ion stream using glow discharge ion ionization.

15. The method of claim 14, wherein said glow discharge ion ionization takes place in a glow discharge ion source having a discharge chamber, said discharge chamber having an entrance orifice for receiving said analyte particles or said analyte vapors and an exit orifice for transmitting out said ion stream, wherein said discharge chamber is pumped exclusively through said exit orifice and said entrance orifice.

16. The method of claim 14, wherein an aerodynamic lens comprising a plurality of constrictions is used for said focusing step.

17. The method of claim 14, further comprising the step of heating said discharge chamber or a target electrode in said discharge chamber to generate said analyte vapors from said analyte particle beam.

18. The method of claim 14, further comprising the step of controlling a pressure in said discharge chamber by leaking a gas into said discharge chamber.

19. The method of claim 14, further comprising the step of irradiating said particles after impact deposition onto an electrode.

20. The method of claim 15, further comprising the step of generating a corona discharge disposed proximate to an inlet of said aerodynamic lens for charging said particle before entering an entrance orifice of said aerodynamic lens.

21. The method of claim 15, further comprising the step of vaporizing particles in said analyte particle beam in a vaporization chamber remote from discharge chamber to provide said analyte vapors.

22. The method of claim 15, further comprising the step of shuttering particles from said aerodynamic lens from reaching said discharge chamber, and pulling said carrier gas from a distal end of said aerodynamic lens to said discharge chamber, wherein exclusively said carrier gas reaches said discharge chamber.

23. The method of claim 14, further comprising the step of analyzing said analyte ion stream using mass spectrometry or ion mobility spectrometry.

* * * * *